US006024823A

United States Patent [19]

Rubin et al.

[11] Patent Number: 6,024,823

[45] Date of Patent: Feb. 15, 2000

[54] WATER-RESISTANT AND STAIN-RESISTANT, ANTIMICROBIAL TREATED TEXTILE FABRIC

[75] Inventors: Craig A. Rubin; Randy B. Rubin, both of Franklin, Mich.; Kyle Bullock, Forest City, N.C.

[73] Assignee: Hi-Tex, Inc., Farmington Hills, Mich.

[21] Appl. No.: 08/687,527

[22] PCT Filed: Mar. 21, 1995

[86] PCT No.: PCT/US95/03566

§ 371 Date: Aug. 7, 1996

§ 102(e) Date: Aug. 7, 1996

[87] PCT Pub. No.: WO95/25843

PCT Pub. Date: Sep. 28, 1995

[51] Int. Cl.[7] ..... B05B 31/00

[52] U.S. Cl. ..... 156/278; 156/272.2; 156/307.1; 427/256; 427/394; 427/396; 427/288

[58] Field of Search ..... 156/234, 230, 156/277, 278, 272.2, 307.1; 427/288, 256, 396, 394; 428/284, 290, 287, 421, 422, 913, 288

[56] References Cited

U.S. PATENT DOCUMENTS

| | | | |
|---|---|---|---|
| 3,713,878 | 1/1973 | Thomas | 117/135.5 |
| 4,518,649 | 5/1985 | Wang et al. | 428/284 |
| 4,721,511 | 1/1988 | Kupits | 8/188 |
| 4,795,675 | 1/1989 | Dunn, Jr. et al. | 428/260 |
| 5,194,667 | 3/1993 | Oxenrider et al. | 560/87 |
| 5,196,080 | 3/1993 | Muzobuchi et al. | 156/234 |

FOREIGN PATENT DOCUMENTS

| | | |
|---|---|---|
| 0097995 | 6/1983 | European Pat. Off. . |

*Primary Examiner*—Merrick Dixon

*Attorney, Agent, or Firm*—Brooks & Kushman P.C.

[57] ABSTRACT

Water-resistant, stain-repellant, anti-microbial fabrics are prepared by treating a woven fabric with a topical treating composition containing an acrylate copolymer having a glass transition temperature in the range of 10° C. to 50° C., a substantial amount of fluorochemical, and an antimicrobial, and curing the treated fabric at elevated temperatures. Further increase in water repellency and stain resistance is achieved by a high solids secondary coating applied to one side of the fabric only. The treated fabric retains the appearance, hand, and feel of textile material while being transfer-printable.

11 Claims, No Drawings

WATER-RESISTANT AND STAIN-RESISTANT, ANTIMICROBIAL TREATED TEXTILE FABRIC

FIELD OF THE INVENTION

The present invention relates to treated textile fabric and more particularly, to a method of preparing a liquid and stain resistant, antimicrobial textile fabric that may be printed by transfer printing, and to the fabric so treated. The present invention further pertains to a liquid and stain resistant textile fabric suitable for applications requiring flame barriers without the use of a distinct flame barrier fabric.

BACKGROUND OF THE INVENTION

Stain resistance, water repellency and resistance to microbial growth are important in many uses of textile materials. In restaurants, for example, table cloths and seating upholstery often lack stain resistance and are subject to rapid water penetration. These properties necessitate frequent cleaning and/or replacement of such items. Although one generally views microbial growth as associated with fibers of biologic origin such as cotton, wool, linen and silk, in the field of marine use, the high relative humidity renders even synthetic polymer textiles such as polyesters and polyamides subject to microbial growth, which is also true of many other outdoor uses.

Textile fabrics may be made water resistant by various processes. For example, textile fabrics may first be scoured with a soap solution and then treated with a composition which may include zinc and calcium stearates as well as sodium soaps. The long chain carboxylic acid hydrophobic compounds provide a limited amount of water repellency. It is also possible to render fabrics liquid resistant by treating the fabric with commercially available silicone, for example poly(dimethylsiloxane).

To overcome problems associated with water absorption and stain resistancy, resort has been made to synthetic leathers and polyvinylchloride (vinyl) coated fabrics. However, these fabrics do not have the hand or feel of cloth, and in general, are difficult and in many cases impossible to print economically. Moreover, although attempts have been made to render such materials water vapor permeable. these attempts have met with only very limited success, as evidenced by the failure of synthetic leather to displace real leather in high quality seating and footwear.

Although the treating and coating methods discussed previously may assist in rendering the fabric partially liquid and/or stain resistant, fabrics thusly treated or coated cannot be satisfactorily printed. The treated liquid resistant fabrics refuse to accept or become incompatible with the application of color dyes. The polymeric coated liquid resistant fabrics cannot be transfer printed because the heat required in the printing process generally causes the polymeric coating to melt or deform. Thus, if a fabric with a particular design or logo is required, the textile fabric must be printed first by traditional methods, following which it may be treated or polymer coated. However, the polymer coating generally obscures the design due to its thickness and opacity, even when non-pigmented vinyl, for example, is used.

Applications of fluorochemicals such as the well known SCOTCHGUARD™ and similar compounds also may confer a limited degree of both water repellency and stain resistance. However, for optimal water repellency, it has proven necessary to coat fabrics with thick polymeric coatings which completely destroy the hand and feel of the fabric. Examples include vinyl boat covers, where the fabric backing is rendered water resistant by application of considerable quantities of polyvinylchloride latex or the thermoforming of a polyvinyl film onto the fabric. The fabric no longer has the hand and feel of fabric, but is plastic-like. Application of polyurethane films in the melt has also been practiced, with similar results. However, unless aliphatic isocyanate-based polyurethanes are utilized, the coated fabric will rapidly weather.

In many industrial, institutional, and commercial applications, severe flame retardant properties are required. Upholstered furniture must often pass the stringent so-called Boston chair or U.K. Crib 5 tests. In these tests, a bag with a weighed quantity of dry newspaper or a crib of wood of specified weight is placed onto the chair and ignited. As the seating cushions, whether of the enclosed spring type with cotton or polyester cushioning, or of the more prevalent polyurethane foam cushioning, are themselves flammable, the cushions in general necessitate covering with a flame barrier of woven fiberglass or the like, then covering with printed upholstery fabric. Fiberglass flame barriers tend to make the cushioning less comfortable as well as creating the potential for penetration of irritating glass fibers into the occupant.

Improvements in flame barriers are disclosed in U.S. Pat. Nos. 4,921,756, 4,996,099, and 5,091,243. In these patents, flame barriers of corespun yarns employing glass or other non-flammable fibers in the core are overwrapped with staple or continuous intumescent polymeric synthetic fibers. However, these barriers, while increasing the comfort of the upholstered furniture, are not liquid or stain resistant, and must still be covered by an exterior printed fabric. Thus, additional manufacturing steps are necessary.

It would be desirable to provide a liquid resistant fabric that may be printed. It would be further desirable to provide a liquid and stain resistant, antimicrobial fabric that may be printed. It would be yet further desirable to provide a fabric that allows water vapor to pass through the fabric while prohibiting the passage of liquid. It would also be desirable to provide a method of producing a liquid and stain resistant, antimicrobial fabric that may be subsequently printed. It would further be desirable to provide a printed, liquid and stain resistant, antimicrobial fabric that retains its natural hand and texture, is easy to handle, and economical to produce. It would still yet further be desirable to provide a liquid resistant, stain resistant, printed fabric which has flammability properties similar to those of flame barrier fabrics.

SUMMARY OF THE INVENTION

The present invention provides a liquid and stain resistant, antimicrobial fabric that is durable enough to withstand the high temperatures required for transfer printing, yet which feels like fabric rather than plastic. The fabric of the present invention is covered with a coating composition comprising a unique copolymer composition containing both antimicrobial agent(s) and fluorochemicals. Once the fabric is thoroughly covered with the coating composition, the fabric may be printed by transfer printing, a process well known in the art. The coated fabric can surprisingly withstand the high temperatures of the transfer printing process, thus producing a liquid and stain resistant, antimicrobial, printed fabric.

BEST MODES FOR CARRYING OUT THE INVENTION

The liquid and stain resistant, antimicrobial, printed fabric of the present invention retains its natural "hand" or texture and is therefore aesthetically attractive. The fabric of the present invention is also durable, easy to handle and economical to produce. Of especial note is the ability to treat long runs of fabric which is undyed or dyed to a uniform background color, which may be later transfer printed with a suitable design or logo after coating. Transfer printing is uniquely adapted to short runs. The combination of these benefits allows stain resistant, water resistant fabrics of varied patterns to be commercially viable, even in short runs. When fabrics are printed prior to coating, most mills require minimal runs of 2000 yds (1900 m) or more, rendering small runs of printed, then coated fabric, commercially unfeasible. Furthermore, the fabric of the present invention has met various flame retardant codes for the upholstery industry.

The fabrics to be coated by the subject process include many textile materials, in particular polyesters, polyacrylics, and polyamides (nylons), including blends of these fibers with each other and with other fibers, for example, natural fibers, such as cotton. When the base fabric comprises a corespun yarn containing fiberglass overwrapped with a synthetic polymeric fiber, the treated fabric is suitable for replacing the flame barrier and printed fabric in upholstery and other applications, and is further suitable for highly flame retardant commercial and industrial uses, for example, as drapery material.

The treating process of the subject invention involves solution coating the fabric with a coating composition which, in its most basic nature, comprises a low solids latex containing a copolymer having a glass transition temperature ($T_g$) of from 10° C. to 35° C., a fluorochemical treating agent, and one or more microbicidides and/or mildewcides. The nature of the coating bath and its composition is such that the fabric is thoroughly treated, the topical coating composition covering equally well both sides of the fabric as well as the interstitial spaces within the fabric. The fabric is then oven dried at elevated temperatures, for example, from 250° F. to 350° F. (121° C. to 177° C.). The fabric thusly treated is mildew resistant and water repellant. In addition, its tensile and tear strengths are markedly improved. Yet, the fabric is very difficult to distinguish from untreated fabric by hand, feel, texture, or ease of handling.

Although the process described above creates a unique new textile material, the material is not completely water resistant. Inspection of the fabric against a light reveals multitudinous "pinholes" which may ultimately allow water to pass through the fabric. To render the fabric water resistant, one or more additional coating steps may be necessary, depending on the degree of water resistance desired. Both these additional steps are the same, and involve the application of a high solids polymeric latex, containing a dispersed polymer with $T_g$ of between −40° C. and −10° C., to one side of the fabric. The latex, with the consistency of wallpaper paste or high solids wood glue, is rolled, sprayed, or otherwise applied to the fabric which then passes under a knife blade, doctor blade, or roller which essentially contacts the textile surface, leaving a thin coating of approximately 1.5 oz/yd$^2$ (50 g/m$^2$) of material. The coated fabric is then oven dried at 250° F. to 350° F. (121° C. to 277° C.).

The resulting fabric still retains excellent hand and feel, although being somewhat less drapeable than the virgin textile material. Inspection against a light shows very few pinholes, which application of a somewhat thicker coating may further reduce. However, even with the relatively few pinholes, the fabric is virtually completely water resistant, able to support a considerable column of water without leakage. If further water resistance is required, this second treatment may be repeated.

The processes of treating textile fabric and the properties of the treated fabric in accordance with the present invention may best be understood in relation to the following detailed description.

The first step in the process of treating fabric in accordance with the present invention involves the application of a penetrating topical coating to the fabric followed by oven drying. The topical coating formulation, hereinafter referred to as the primary coating or coating composition, is an aqueous bath containing from 3 weight percent to about 25 weight percent solids, preferably from 4 weight percent to 20 weight percent solids, of which approximately 20 weight percent to 50 weight percent represent latex copolymer solids. This primary, topical treatment bath, contains minimally the following components: a copolymer latex; a fungicide; and a fluorochemical textile treating composition. In preferred embodiments, the primary bath may further include a crosslinking agent, a fire retardant and/or smoke suppressant, and other additives and auxiliaries such as dispersants, thickeners, dyes, pigments, ultraviolet light stabilizers, and the like.

The copolymer latex is present in an amount sufficient to supply preferably 3 to about 12 weight percent solids to the formulation, more preferably 3 to about 10 weight percent, and most preferably 4 to about 7 weight percent. The copolymer particles constituting the latex solids should have a glass transition temperature less than 50° C., preferably in the range of 10 to 35° C., most preferably about 20° C. Copolymers having glass transition temperatures appreciably below 10° C. may not present optimal stain resistance. Preferably, the surfactant content of the latex is as low as possible to provide for good water repellency and water resistance.

The nature of the monomers from which the polymer particles of the copolymer latex may be formed may be adjusted by one skilled in the art to provide the properties desired of the coated fabric. Preferably, the latex particles are acrylate copolymers, i.e. copolymers formed from lower alkyl acrylates such as methylacrylate, ethylacrylate, butylacrylate, methylmethacrylate, and the like, as well as additional copolymerizable monomers such as vinyl acetate, acrylonitrile, styrene, acrylic acid, acrylamide, N-methylacrylamide, and urethane acrylates. The presence of crosslinkable groups such as acrylamide and N-methylacrylamide along the polymer backbone is preferred. Terpolymers of styrene, methylacrylate, and ethylacrylate are very suitable. Most preferred is WRL1084, a styrene, methylacrylate, ethylacrylate copolymer containing N-methylacrylamide in the polymer backbone available from B.F. Goodrich. The copolymer lattices are available in varying solids contents, for example, from 30 to 60 weight percent, which are then added to formulating water to provide the desired solids content in the first coating composition.

The antimicrobial agent comprises preferably about 0.25% to about 4% by weight of the aqueous coating composition more preferably 0.40 to about 2 weight percent, and most preferably 0.40 to 1 weight percent. By "antimicrobial agent" is meant any substance or combination of substances that kills or prevents the growth of a microorganism, and includes antibiotics, antifungal, antiviral and antialgal agents. The preferred antimicrobial agent is ULTRA FRESH™, available from Thomas Research, and INTERSEPT™, available from Interface Research Corporation, may also be employed. Other antimicrobials, particularly fungicides, may be used. Examples are various tin compounds, particularly trialkyltin compounds such as tributyl tin oxide and tributyl tin acetate, copper compounds such as copper 8-quinolinolate, metal complexes of dehydroabietyl amine and 8-hydroxyquinolinium 2-ethylhexoate, copper naphthenate, copper oleate, and organosilicon quarternary ammonium compounds.

The fluorochemical textile treating agent comprises about 6% to about 12% by weight of the coating composition, preferably 10%. The fluorochemicals provide water and stain resistance and may comprise unbranded generic fluoropolymers. Commercially available fluorochemical compositions such as SCOTCHGUARD™ FC 255, SCOTCHGUARD™ FC 214-230, available from 3M, and TEFLON® RN, TEFLON® 8070, and TEFLON™ 8787, available from Dupont, are preferred. TEFLON™ 8070 is the most preferred fluorochemical. It is noteworthy that the amount of fluorochemical treating agent used is considerably higher than amounts traditionally used for treating upholstery fabric to render it stain resistant.

Crosslinking agents suitable for use in the present invention include both chemical agents which promote crosslinking of crosslinkable groups along the latex copolymer chains as well as crosslinkable resins which may crosslink with the copolymer or which are themselves crosslinkable. A preferred crosslinking agent which facilitates copolymer crosslinking is zinc ammonium carbonate. Preferred self-crosslinking resins are the various melamine/formaldehyde and phenol/formaldehyde resins and their variants, particularly CYREZ® 933, a product of the American Cyanamid Company. Other phenol, melamine, urea, and dicyandiamide based formaldehyde resins are available commercially, for example, from the Borden Chemical Company. Preferably, melamine/formaldehyde resin in the amount of 0.1 to about 1.0 weight percent, preferably about 0.25 weight percent based on the weight of the aqueous treating composition is used. Other crosslinkable resins such as oligomeric unsaturated polyesters, mixtures of polyacrylic acid and polyols, e.g. polyvinylalcohol, and epoxy resins may also be used, together with any necessary catalysts to ensure crosslinking during the oven drying cycle.

The fabrics produced by the subject process are, in general, flame retardant. However, it would not depart from the spirit of the invention to add additional flame retardants and/or smoke suppressants. Suitable flame retardants are known to those skilled in the art of fabric finishing, and include, for example, cyclic phosphorate esters such as Antiblaze 19T available from Mobil Chemical Co.

The order of mixing the ingredients of the primary bath is not very critical. In general, the copolymer latex is first mixed with make-up water and stirred at ambient temperature until uniformly dispersed, following which the microbicide and fluorochemical treating agent and other ingredients are added. The mixture is stirred until a uniform dispersion is obtained.

The fabric to be coated may be drawn through the treating bath by any convenient method, or the treatment solution may be sprayed or rolled onto the fabric. Preferably, the fabric, previously scoured to remove textile yarn finishes, soaps, etc., is drawn through the bath, as the topical treatment of the first treating step should uniformly coat both surfaces of the textile as well as its interior. The fabric, after being drawn through the bath, may be passed through nips or nip rollers to facilitate more thorough penetration of the treating composition into the fabric and/or to adjust the amount of treatment composition by the fabric. By such or other equivalent means, the pickup is adjusted to provide from 30 to 200 weight percent pickup relative to the weight of the untreated fabric, more preferably from 60 to 150 weight percent, and most preferably from 80 to 120 weight percent. A 100 weight percent addition of treatment solution is considered optimal with normal primary bath solids content. The treated fabric is then passed through an oven maintained at an elevated temperature, preferably from 250° F. to 350° F. (121° C. to 277° C.) for a period sufficient to dry the applied coating, and, if the first treatment step is not to be followed by additional treatment, to perform any necessary crosslinking of the components of the treatment composition. Generally, a period of from 1 to 8 minutes, preferably about 2 minutes at 325° F. (163° C.) is sufficient.

The treating process of the subject invention is advantageously applied to flame barrier fabrics prepared from corespun yarns, preferably with a fiberglass core, as disclosed in U.S. Pat. Nos. 4,921,756, 4,996,099, and 5,091,243, which are herein incorporated by reference. The yarns used in these fabrics comprise an interior core of fiberglass or other non-flammable fiber covered by a shell of polymeric synthetic fibers. Preferably, the synthetic fibers are staple fibers, and are overwrapped in a spiral fashion by continuous fibers to maintain yarn integrity. Other flame barrier fabrics may be utilized as well.

The polymeric synthetic fiber which surrounds the non-flammable core of the corespun yarn may be one of a number of synthetic polymer fibers, including, but not limited to, acrylic, modacrylic, polyester, nylon, and the like. For treated fabrics which are to be subsequently transfer printed, the synthetic polymer fibers should be able to withstand the heat of the transfer printing process.

When barrier fabrics are treated in accordance with the subject invention, several unique advantages accrue. First, the use of the treated barrier fabric provides a covering which not only possesses the necessary flame barrier properties, but moreover is liquid resistant and stain resistant. Moreover, due to the nature of the coating process, the treated barrier fabrics may be transfer printed, thus allowing for aesthetic exterior uses, not only in furniture upholstery, but in other applications requiring a high level of flame resistance such as commercial and institutional draperies and wall coverings. Furthermore, as the treated barrier fabrics may be transfer printed, exterior upholstery use eliminates the necessity of a separate barrier fabric. Such uses amount not only to considerable savings in manufacture and thus ultimate consumer cost, but moreover, can effect substantial weight savings, important in such application as commercial aircraft seating.

The treated fabric of the subject invention has a number of advantageous and unique characteristics. It is highly, although not totally, water resistant, as well as stain resistant and sufficiently non-flammable to meet various flammability requirements such as California 117, Section E. While highly water resistant, the fabric allows ready passage of water vapor, and is thus eminently suited for items such as boat covers, traditionally made of vinyl-coated fabrics. The vinyl-coated fabrics are substantially water vapor impermeable, and contribute to mildew formulation in boats using such covers. The treated fabric has substantially the same hand, feel, texture, and drape of uncoated fabric, and thus can be manipulated by traditional manufacturing techniques as well as being aesthetically pleasing. The fabric is also considerably more resistant to tear and opening at needle holes, as well as having higher tensile strength. Importantly, the treated fabric may be transfer printed.

For more complete water resistance, one or more subsequent secondary treatments are utilized. The secondary treatment compositions utilized for the second and subsequent treatments are different from those of the primary treatment, although the latter treatment may be repeated as well. The second and subsequent treatments are designed to increase stain resistance and also to render the fabric virtually totally water resistant. Like the fabrics which receive only one or more primary treatments, the fabrics obtained after treatment with the secondary treatment composition are able to be transfer printed without difficulty.

The second treatment composition comprises a copolymer latex, one or more microbicides, and a fluorochemical textile treatment agent. However, in contrast to the primary treatment bath, the copolymer of the copolymer latex of the secondary treatment composition has a glass transition temperature of 0° C. or lower, preferably −10° C. or lower, and preferably within the range of −40° C. to −10° C., and is preferably a styrene/acrylate copolymer. The amount of copolymer latex solids is also considerably higher, for example, 90–95% of a 50% solids latex. The treatment composition should contain from 30 to 60 weight percent copolymer solids, preferably 35 to 55 weight percent, and most preferably about 45 to 52 weight percent. Thickeners are generally necessary to adjust the rheological properties of the secondary treatment composition. Such thickeners are well known, and include water soluble, generally high molecular weight natural and synthetic materials, particularly the latter. Examples of natural thickeners include the various water soluble gums such as gum acacia, gum tragacanth, guar gum, and the like. More preferred are the chemically modified celluloses and starches, such as methycellulose, hydroxymethylcellulose, propylcellulose, and the like. Most preferred are high molecular weight synthetic polymers such as polyacrylic acid; copolymers of acrylic acid with minor amounts of copolymerizable monomers such as methyl acrylate, methacrylic acid, acrylonitrile, vinylacetate, and the like, as well as the salts of these compounds with alkali metal ions or ammonium ions; polyvinylalcohol and partially hydrolyzed polyvinylacetate; polyacrylamide; polyoxyethylene glycol; and the so-called associative thickeners such as the long chain alkylene oxide capped polyoxyethylene glycols and polyols or their copolymer polyoxyethylene/polyoxypropylene analogues. The length of the carbon chain of the long chain alkylene oxide in associative thickeners has a great effect on the thickening efficiency, with alkylene residues of 8–30 carbon atoms, preferably 14–24 carbon atoms having great thickening efficiency. The thickener may be used in amounts up to 4 weight percent, preferably about 2 weight percent or less. In contrast to the copolymer latex, in which the solids are dispersed, the thickener solids are water soluble in the amounts used.

The remaining ingredients are similar to those of the first treatment composition, and may include, based on 200 lbs (91 Kg) of 50% solids treatment composition, from 2 to 12 lbs (0.91 to 5.4 Kg) fluorochemical textile treating agent, preferably 4 to 10 lbs (1.8 to 4.5 Kg), and most preferably, 6 to 8 lbs (2.7 to 3.6 Kg); 0.25 to 3 lb (0.11 to 1.4 Kg) of one or more microbicides, preferably 0.5 to 2 lbs (0.23 to 0.91 Kg), and most preferably about 0.5 lb (0.23 Kg) each of ULTRAFRESH™ DM-50 and ULTRAFRESH™ UF-40 biocides available from Thompson Research Corporation. The preferred compositions, on the same basis, further contain 2 weight percent zinc ammonium carbonate; 20 lbs (9.1 Kg) of an aqueous 50% solids calcium stearate dispersion; 2 lbs (0.91 Kg) zinc borate; 0 to 3 lbs (0 to 1.4 Kg) melamine/formaldehyde resin, preferably CYREZ 933; and 2 weight percent of sodium polyacrylate thickener solids, supplied as a 14 to 20 weight percent solids solution.

Fire retardants which are dispersible may be added to the secondary treatment composition in the place of or in addition to those previously described. An example is Caliban P-44, containing decabromodiphenyloxide and antimony oxide available from White Chemical Company. A suitable smoke suppressant is zinc borate, which may be used in the amount of 2 weight percent based on solids.

The resulting composition is considerably more viscous than the first treatment composition, and has a consistency similar to that of PVA wood glue or wallpaper paste. If the fabric is to be subsequently transfer printed, the composition may further contain 3 to 7 weight percent polydimethylsiloxane silicone fluid. This fluid counteracts the tackiness which may develop in the coating during the elevated temperatures associated with transfer printing which might otherwise result in the coating sticking to the print blanket which surrounds the heated transfer printing roll.

Unlike the primary, topical treatment, which is applied to both sides of the fabric by virtue of immersion in a bath, the second and subsequent treatments are applied to one side of the fabric only, the side to be exposed to the environment and to be optionally transfer printed.

The amount of the secondary treatment applied may vary. Preferably, a doctor blade or knife edge is adjusted to touch or nearly touch the fabric surface as the fabric, coated with the composition, passes by. Although the coating may be as much as 1 mm thick above the fabric, it is preferred that the wet surface of the coating be at substantially the height of the uppermost yarns of the fabric. When subsequently dried, the thickness of the coating will, of course, be considerably reduced.

It is of great importance that the primary treatment precede the secondary or subsequent treatment(s). The primary treatment interferes with the penetration of the secondary treatment into the fabric, and thus limits the amount of secondary treatment composition which the fabric can obtain with a given knife blade setting. The inability of the secondary treatment composition to substantially penetrate into the fabric assists in maintaining the hand and feel of the fabric, which otherwise would be stiff and boardy.

Following the secondary treatment, the fabric against is oven dried, at temperatures from 250° F. to 350° F. (121° C. to 277° C.), preferably 300 to 350° F. (149° C. to 277° C.). As a result of the primary, secondary, and any subsequent treatments, the weight of the finished fabric will have increased by from 70% to 200%, preferably from 80% to about 150%, and particularly from 90% to 120%.

It will be appreciated by those skilled in the art that the amount of the copolymer composition, antimicrobial agent, fluorochemicals and additives may be varied depending on the desired result of the coating composition. For example, fabric of tighter weave may require only a primary treatment or a primary treatment and one secondary treatment whereas an open weave fabric may require primary treatment and two or more secondary treatments. It will also be appreciated that the combination of the various components of the composition of the present invention may be varied to achieve the desired result. For example, the solids content of the primary treatment composition, secondary composition, or both may be increased to reduce the overall number of treatments required.

As mentioned above, the fabric of the present invention is durable, easy to handle and economical to produce. Because the fabric retains its "hand" or texture, the fabric is easy to sew and seams are less noticeable, and more durable. For example, when vinyl is sewed, the needle holes tend to open when the vinyl is stretched. With the fabric of the present invention, needle holes do not tend to open and thus the seams are stronger and less noticeable. The fabric of the present invention also has flame retardant characteristics, as described in greater detail below. Moreover, while the fabric provides a moisture barrier, it is believed that vapors are allowed to pass through the fabric. Human skin which may come in contact with the fabric, for example in upholstery applications, is therefore less likely to perspire.

The following Specific Examples further describes the present invention.

EXAMPLE 1

A heat set and scoured polyester fabric of 40 picks/inch (15.7-picks/cm), previously dyed an emerald green color, was immersed into a primary, aqueous treatment bath containing 5 weight percent latex solids, WRL 1084 (B.F. Goodrich), 10 weight percent TEFLON® 8070 fluorochemical, 0.25 weight percent CYREZ 933 melamine/formaldehyde resin, and 0.5 weight percent of ULTRAFRESH™ DM50 biocide, balance water. The treated fabric was passed through nip rolls whose pressure was adjusted to provide for 100% primary treatment composition pickup. The fabric was then dried for approximately 2 minutes by passage through a drying oven maintained at 325° F. (163° C.). The treated fabric exhibited a c.a. 9% weight gain after drying. The resulting treated fabric displayed virtually no change in color, was able to support a considerable column of water, indicating good water resistance, and was stain resistant. The fabric was water vapor permeable, and had excellent hand, feel, and texture. The tear strength and tensile strength was considerably improved relative to the untreated fabric. Examination of the fabric against a strong light showed the presence of numerous pinholes. Nevertheless, the water resistance was such as to make the fabric eminently well suited for boat covers and other outdoor applications, particularly those where water vapor transmission is desirable.

EXAMPLE 2

An undyed polyester fabric similar to that used in Example 1 was subjected to the primary treatment of Example 1. The fabric, when viewed against a strong light, exhibited numerous pinholes, but was water resistant. The primary treated fabric was then coated with a secondary treatment composition containing 200 lbs (91 Kg) of a 50 weight percent solids latex identified as WRL 1402 available from BF Goodrich; 2 lbs (0.91 Kg) CYREZ™ 933 melamine/formaldehyde resin; 2 lbs (0.91 Kg) zinc borate; 7 lbs (3.2 Kg) Zonyl RN fluorochemical, available from E.I. DuPont de Nemours; 20 lbs (9.1 Kg) of a 50 weight percent calcium stearate dispersion; 2 lbs (0.91 Kg) of zinc ammonium carbonate; 1.0 lb (0.45 Kg) each of ULTRAFRESH™ DM 50 and UF40 biocides; and 7 lb (3.2 Kg) polydimethylsiloxane available from the DOW Chemical Company. The secondary coating composition had the consistency of wallpaper paste, after thickening with 2 lbs. (0.91 Kg) of polyacrylate thickener.

The fabric, coated with excess secondary treatment composition on the uppermost side only, was passed below a knife blade adjusted to contact the topmost yarn surfaces of the fabric, removing excess secondary treatment solution. The fabric was then dried in a drying oven maintained at 325° F. (163° C.) for a period of 2 minutes.

The fabric obtained after the secondary treatment showed an increase in weight of about 706% based on the virgin fabric. The fabric was virtually totally water resistant, supporting a higher column of water than the same fabric after treatment with the primary treatment bath only. However, examination under a strong light showed evidence of occasional pinholes. The fabric had excellent hand and feel, although somewhat stiffer than the virgin fabric.

The same fabric was subjected to a subsequent treatment identical to the previous secondary treatment. Total weight gain after drying, relative to the virgin fabric, was 100%. Examination against a strong light showed no observable pinholes.

After the fabric has been suitably coated, the fabric is caused to be printed by transfer printing. Transfer printing is generally known in the art. In transfer printing, color designs mounted on paper carriers are transferred to the coated fabric. The color designs may be transferred from the paper carriers to the coated fabric by pressure-heat contact methods or by heat-vaporization (sublimation) methods. For example, color-prints on a paper carrier are made to come in continuous contact with the treated fabric, and while in contact, pressure is applied between a blanket and a roller. The pressure is about 50 lbs/in$^2$ (34 N/cm$^2$) to about 60 lbs/in$^2$ (41 N/cm$^2$), with 60 lbs/in$^2$ (41 N/cm$^2$) preferred. Heat is also applied at about 380° F. to about 430° F. (193° C. to 221° C.), preferably at 420° F. (216° C.). The dwell time, or time where heat and/or pressure are applied, is a time sufficient for the prints to be transferred to the fabric, preferably about 15 sec to about 30 sec. The heat and pressure permit the transfer of the color design from the paper carrier to the fabric. Transfer of the prints from the paper carrier can also be effected by the use of heat-vaporization methods, known to those skilled in the art. It will, of course, be appreciated by those skilled in the art that the coated fabric of the present invention may have color prints printed thereon in any number of ways, and there is no limitation on the number of colors, the variations and graduation of color, and number of different configurations of prints that can be applied. Moreover, there are any number of ways such prints can be transferred to the coated fabrics and the above are merely representative methods.

The treated fabric of Example 2 of the present invention was tested for flammability, resistance to staining, resistance to yarn slippage at seams, tensile strength and tear strength. The following is a summary of the tests and testing results.

Flammability. The treated fabric was tested in accordance with the State of California Home Furnishings Act, Bulletin 117 Section E, (Cal. 117) using apparatus and methods outlined in Title 16 C.F.R. Section 1610 "Standard for the Flammability of Clothing Textiles," herein incorporated by reference. The treated fabric of the present invention met the standards set forth in the State of California Home Furnishings Act, Bulletin 117 Section E. The treated fabric was further rated as a UFAC Class 1 material.

Resistance to Staining. The treated fabric was tested under the BFTB 402 Standard test conditions for resistance to staining. The following rating system was used:

Class 4: Complete removal

Class 3: Good removal, traces of stain removed

Class 2: Fair removal, more than 50% stain removed

Class 1: Poor removal, less than 50% stain removed

The following table summarizes the test results:

| | RATING FOR AMOUNT OF REMOVAL | | | |
|---|---|---|---|---|
| | WATER BASE REMOVAL | | SOLVENT BASE REMOVAL | |
| Type of Stain | After 5 min Aging | After 5 min Aging | After 5 min Aging | After 5 min Aging |
| Blood | Class 4.0 | Class 4.0 | Class 4.0 | Class 4.0 |
| Urine | Class 4.0 | Class 4.0 | Class 4.0 | Class 4.0 |
| Betadine | Class 4.0 | Class 4.0 | Class 3.0 | Class 2.0 |

Resistance to Yarn Slippage at Seams. The treated fabric was tested under the ASTM D4034 standard test conditions for resistance to yarn slippage at seams. The ASTM D 3597 specification for woven upholstery fabrics (plain, tufted or flocked) requires a 25 lb (111 N) minimum. In the preliminary test, the seam thread break was at 95 lbs (423 N) and the fill seam thread break was at 87 lbs (387 N). In the remaining four samples, the average seam strength, caused by thread break, was 92 lbs (409 N).

Tensile Strength. The treated fabric was tested under the ASTM D 5034 standard test conditions for tensile strength (grab). The ASTM D 3597 specification for woven upholstery fabric requires a 50 lb (222 N) minimum. Five samples were tested and the average tensile warp strength was 284.8 lbs (1.27 KN) and the average tensile fill strength was 196.4 lbs (874 N).

Tear Strength. The treated fabric was tested under the ASTM D 2261 standard test conditions for tear strength (tongue). The ASTM D 3597 specification for woven upholstery fabrics (plain, tufted or flocked) requires a 6 lb (27 N) minimum. Five samples were tested and the average across the wrap was 15.4 lbs (68.5 N) and the average across fill was 15.4 lbs (68.5 N).

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the specification and following claims.

What is claimed is:

1. A stain resistant and water resistant treated textile fabric suitable for use in transfer printing processes, said fabric prepared by a process comprising:

a) selecting an untreated woven textile fabric containing minimally 30 weight percent of synthetic polymeric fibers;

b) topically treating said fabric with from 30 weight percent to 200 weight percent based on the weight of the untreated fabric of an aqueous primary treating composition comprising;

b) i) a copolymer latex dispersion in an amount effective to supply from 3 weight percent to about 15 weight percent copolymer solids to said primary treatment solution, said copolymer being an acrylate copolymer having a glass transition temperature in the range of 10° C. to 50° C.;

b) ii) from 0.25 weight percent to about 4 weight percent of a microbicide; and b) iii) from 5 to about 15 weight percent of a fluorochemical textile treating agent;

c) drying the topically treated fabric at an elevated temperature to obtain a primary treated fabric;

d) applying to one side of said primary treated fabric, from 60 weight percent to about 150 weight percent, based on the weight of untreated woven textile fabric, of a secondary aqueous treatment composition comprising:

d) i) a secondary copolymer latex dispersion in an amount effective to supply from 30 weight percent to about 60 weight percent copolymer solids to said secondary aqueous treatment composition, said secondary copolymer being an acrylate copolymer having a glass transition temperature of less than 0° C.;

d) ii) from 0.25 weight percent to about 4 weight percent of a microbicide; and d) iii) from 0 to about 12 weight percent of a fluorochemical textile treating agent;

e) drying the secondary composition treated fabric (d) at an elevated temperature to obtain a multi-treated fabric.

2. The treated fabric of claim 1 wherein said acrylate copolymer is a crosslinkable acrylate copolymer.

3. The treated fabric of claim 1 wherein said primary treating composition further comprises an amount of a crosslinking agent effective to crosslink said crosslinkable acrylate polymer.

4. The treated fabric of claim 1 wherein said primary treatment composition further comprises a crosslinkable resin in an amount of from 0.1 weight percent to about 4 weight percent.

5. The treated fabric of claim 1 wherein said crosslinkable resin comprises a formaldehyde based resin prepared by the reaction of formaldehyde with a member of the group consisting of melamine, phenol, dicyandiamide, urea, and mixtures thereof.

6. The treated fabric of claim 1 wherein said secondary treatment composition further comprises:

d) iv) from 0.1 to about 5 weight percent of an organic polysiloxane.

7. The treated fabric of claim 1 wherein said acrylate copolymer has a glass transition temperature between 10° C. and 35° C.

8. A transfer printed stain resistant and water resistant treated textile fabric, said fabric prepared by a process comprising:

a) selecting an untreated woven textile fabric containing minimally 30 weight percent of synthetic polymeric fibers;

b) topically treating said fabric with from 30 weight percent to 200 weight percent based on the weight of the untreated fabric of an aqueous primary treating composition comprising;

b) i) a copolymer latex dispersion in an amount effective to supply from 3 weight percent to about 15 weight percent copolymer solids to said primary treatment solution, said copolymer being an acrylate copolymer having a glass transition temperature in the range of 10° C. to 50° C.;

b) ii) from 0.25 weight percent to about 4 weight percent of a microbicide; and b) iii) from 5 to about 15 weight percent of a fluorochemical textile treating agent;

c) drying the topically treated fabric at an elevated temperature to obtain a primary treated fabric;

d) applying to one side of said primary treated fabric, from 60 weight percent to about 150 weight percent, based on the weight of untreated woven textile fabric, of a secondary aqueous treatment composition comprising:

d) i) a secondary copolymer latex dispersion in an amount effective to supply from 30 weight percent to about 60 weight percent copolymer solids to said secondary aqueous treatment composition, said secondary copolymer being an acrylate copolymer having a glass transition temperature of less than 0° C.;

d) ii) from 0.25 weight percent to about 4 weight percent of a microbicide; and d) iii) from 0 to about 12 weight percent of a fluorochemical textile treating agent;

e) drying the secondary composition treated fabric (d) at an elevated temperature to obtain a multi-treated fabric;

f) transfer printing said multi-treated fabric by the steps of f) i) applying a color print design to a paper carrier;

f) ii) contacting said paper carrier having thereon said color print design with said multi-treated fabric; and f) iii) applying heat and pressure sufficient to transfer said color print design to said multi-treated fabric.

9. The method of claim 8, wherein the pressure of step c) is about 50 lbs to about 60 lbs for about 15 sec to about 30 sec.

10. The method of claim 8, wherein the temperature of step f) iii) is about 380° F. to about 430° F.

11. The method of claim 8, wherein the color print design is caused to be transferred by applying heat which vaporizes said color print design.

* * * * *

UNITED STATES PATENT AND TRADEMARK OFFICE

CERTIFICATE OF CORRECTION

PATENT NO. : 6,024,823
DATED : February 15, 2000
INVENTOR(S) : Craig A. Rubin et al.

It is certified that error appears in the above-identified patent and that said Letters Patent is hereby corrected as shown below:

Column 8,
Line 24, the words "opposite to" should be inserted after the word "only".

Signed and Sealed this

Twenty-first Day of August, 2001

*Attest:*

Nicholas P. Godici

NICHOLAS P. GODICI
*Acting Director of the United States Patent and Trademark Office*

*Attesting Officer*